United States Patent [19]

Artzt et al.

[11] Patent Number: 4,788,817

[45] Date of Patent: Dec. 6, 1988

[54] AUTOMATIC PIECING OF COMBINATION OPEN END ROTOR SPUN YARN

[75] Inventors: Peter Artzt; Gerhard Egbers, both of Reutlingen; Heinz Muller, Metzingen-Neuhausen; Ullrich Stark, Stuttgart, all of Fed. Rep. of Germany

[73] Assignee: E. I. Du Pont de Nemours and Company, Wilmington, Del.

[21] Appl. No.: 164,706

[22] Filed: Mar. 7, 1988

[51] Int. Cl.[4] ..... D01H 15/02; D02G 3/38

[52] U.S. Cl. ..... 57/263; 57/5; 57/202; 57/408

[58] Field of Search ..... 57/22, 202, 261–263, 57/5, 6, 238, 408, 409

[56] References Cited

U.S. PATENT DOCUMENTS

| | | | |
|---|---|---|---|
| 3,445,993 | 5/1969 | Vorisek | 57/6 |
| 4,022,011 | 5/1977 | Hirai | 57/263 |
| 4,083,173 | 4/1978 | Artzt et al. | 57/5 X |
| 4,221,110 | 9/1980 | Smith | 57/263 |
| 4,302,925 | 12/1981 | Edagawa et al. | 57/409 X |
| 4,489,544 | 12/1984 | Morita et al. | 57/263 X |
| 4,729,214 | 3/1988 | Yngve et al. | 57/6 |

*Primary Examiner*—John Petrakes

[57] ABSTRACT

An improved method and apparatus for stringing up or re-stringing a balanced ply-twisted combination yarn of two components to insure strong piecing-up points. The end of the combination yarn and the end of a continuous filament yarn, which becomes a component of the combination yarn, are both prepared for piecing and inserted into the rotor of an open-end spinning device. Upon start up, the combination yarn engages staple fibers in the rotor consolidating groove while the continuous filament yarn engages the combination yarn within the rotor without any contact of the continuous filament yarn with the rotor consolidating groove.

6 Claims, 9 Drawing Sheets

1
1'
1''
2
2'
3
4
5
6
7
8
9
10
11
13
14
15
16
17
20
22
23
24
25
28
29
31
32
33
34
36

AUTOMATIC PIECING OF COMBINATION OPEN END ROTOR SPUN YARN

BACKGROUND OF THE INVENTION

The present invention relates to a method for piecing a combination yarn at operating speed, and, more particularly, to an automatic method for piecing a combination yarn, comprising a rotor spun staple yarn ply-twisted with a continuous yarn, by preparing the ends of the continuous yarn and the ply-twisted combined yarn and feeding them into the rotor from two directions in a timed sequence. The present invention also relates to the apparatus for piecing the yarn and to the yarn having been pieced together according to the method of this invention.

Rotor spinning or open-end spinning, a technique developed in the 1960's, twists staple fibers into yarn by feeding the fibers to the inside wall of a cup-shaped rotor operating at high rotational speed. Centrifugal force compacts the fibers into a consolidation groove, and the fibers are twisted together by the rotation of the rotor as they are led inward toward the axis of rotation and are removed through an axial passage. Lower cost and high production rates for this process compared to traditional staple ring spinning has led to its increased use.

To minimize the time required to begin spinning on an open-end spinning position or to re-string a yarn after a break, various manual, semi-automatic and automatic methods have been developed. Some representative methods are described in U.S. Pat. Nos. 4,022,011, 4,221,110 and U.S. Pat. No. 4,489,544; British Pat. Nos. 1,291,900 and 2,164,961; and published European Patent Application No. 127,017-A.

Two or more yarns to be used as pile in cut pile carpets are conventionally true twisted together in a relatively slow process. Higher speeds are possible in open-end rotor spinning when a first yarn is twisted from staple and a second yarn is fed through the axis of the rotor and is ply-twisted with the newly-formed staple yarn. The second yarn may either be staple or continuous filament. Such methods are disclosed, for example, in Miklas, Z: "Production of Wrap-Spun OE Rotor Yarns, and their Application"; Melliand Textilberichte, pages 10–16 (English Ed.), January, 1984, and in U.S Pat. No. 4,729,214 application Ser. No. 004,608 filed Jan. 20, 1987 (Yngve et al.).

One method of starting a similar two-yarn plying operation is disclosed in (Artzt et al.) U.S. Pat. No. 4,083,173 (column 2, line 52, through column 3, line 3). The present invention is an improved method and apparatus for strung up or re-stringing a ply-twisted combined yarn of two components to insure strong piecing-up points.

SUMMARY OF THE INVENTION

The present invention is an improved method for piecing together a continuous filament yarn and a rotor spun staple yarn with the broken end of a two-ply combination yarn formed by ply-twisting a continuous filament yarn with a yarn of staple fiber on an open-end rotor spinning machine which includes a spinning rotor having a hollow spindle and a consolidating groove, a stationary doffing tube having a navel (attached on the entrance), a pair of cooperating continuous filament yarn feed rolls, a sliver delivery roll, an opening roller, a pair of cooperating take-up rolls, and a winding-up mechanism comprising the steps of:

disengaging said rotor, feed rolls, delivery roll, take-up rolls and winding-up mechanism;

removing staple fiber from the rotor; clamping and cutting said continuous yarn and preparing the end of said continuous yarn by placing said cut end approximately flush with the bottom of the rotor spindle (for restarting);

cutting the combination yarn through both components and preparing the end of said yarn by removing a portion of the staple component to expose the continuous yarn component;

returning the rotor to operating speed;

engaging the sliver delivery roll to deliver a predetermined amount of staple fiber into the rotor;

moving the prepared end of the combination yarn into the consolidation groove of the spinning rotor;

moving the end of said continuous yarn under controlled conditions into contact with the rotating combination yarn end within the navel without any contact of said continuous yarn with the consolidation groove of the spinning rotor; and by engaging the take-up rolls, the feed rolls, and the winding mechanism in a predetermined timed sequence to begin take-up and wind-up of the combination yarn.

The method of this invention comprises two basic phases: a preparatory phase, which may be completely automated or semi-automated, and a piecing-up phase in which the joining of the broken end of the combination yarn with the rotor spun staple component and the continuous filament yarn takes place. The piecing-up phase is totally automatic.

The present invention relates further to a pieced-together balanced ply-twisted yarn formed by the method of this invention. Such a yarn is characterized by having a strong piecing joint in which the thickness of the joint is about the same as the balanced ply-twisted finished combined yarn, and no component can be seen protruding from the bundle.

BRIEF DESCRIPTION OF THE DRAWINGS

FIGS. 3–6B are schematic side elevations, partly in section, of an open-end spinning machine showing sequential steps in practicing the method of the invention.

DETAILED DESCRIPTION OF THE INVENTION

Figure 1:
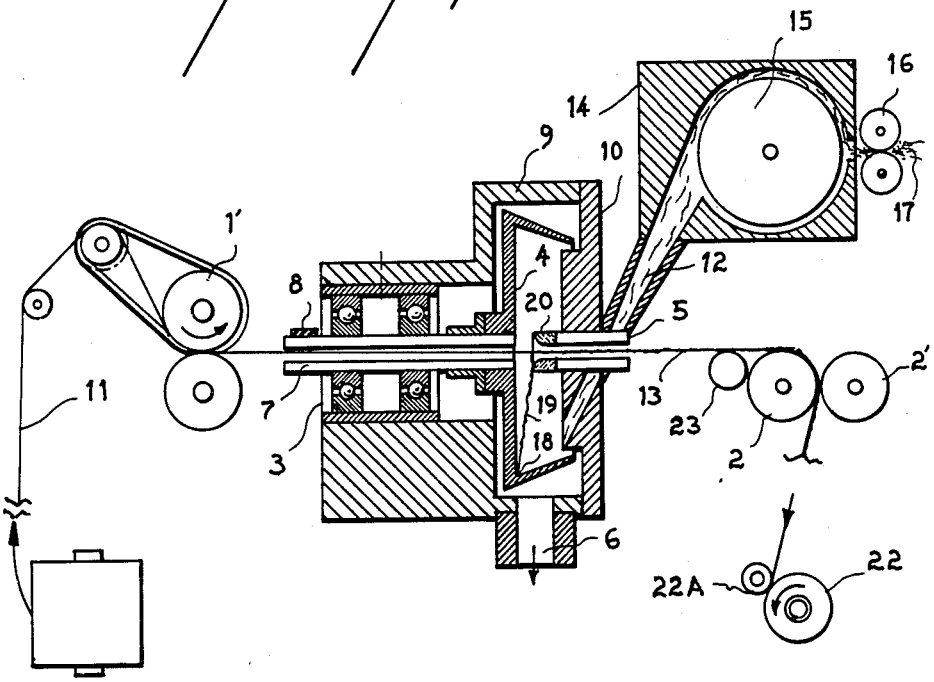
FIG. 1 is a schematic side elevation, partly in section, of an open-end spinning machine to which the method of the present invention can be applied.

Referring now to the drawings, FIG. 1 shows the essential parts of a typical open-end spinning machine to which the method of the present invention applies and which comprises a spinning rotor 4, cooperating feed rolls 1 and $1^1$, for advancing a continuous filament 11 under controlled conditions into the hollow rotor spindle, a sliver delivery roll 16 and an opening roller 15 for feeding individual staple fibers 12 into the rotor groove 18 and take-away rolls 2 and $2^1$ for removing the finished two-ply yarn 13 for collection on a package 22. Such a spinning machine and a method of forming a balanced ply-twisted combination yarn are described in U.S. patent application Ser. No. 4,608, filed Jan. 20, 1987, now U.S. Pat. No. 4,729,214, the teachings of which are incorporated herein by reference.

In operation, a balanced ply-twisted combination yarn is formed by feeding a continuous filament yarn 11 into hollow spindle 7 of an open-end spinning rotor 4 which is suspended by bearings 3 and is driven by belt 8 or a separate motor drive. The continuous filament yarn 11 is advanced, i.e., fed, by a pair of cooperating feed rolls 1 and $1^1$.

Staple sliver 17 is fed by at least one sliver delivery roll 16 into an opening roller 15 which separates the individual staple fibers 12 from the sliver and delivers them along with an inwardly-directed current of air into consolidating groove 18 of rotor 4. The staple fibers 12 are packed by centrifugal force into a consolidating groove 18 and are twisted into a coherent staple yarn 19 by the spinning motion of rotor 4 as yarn 19 is drawn, i.e., taken away, from groove 18 by a pair of cooperating take-away rolls 2 and $2^1$. The feed rate of the continuous filament yarn 11 is normally about 1–3% greater than the take-away rate.

Figure 2:
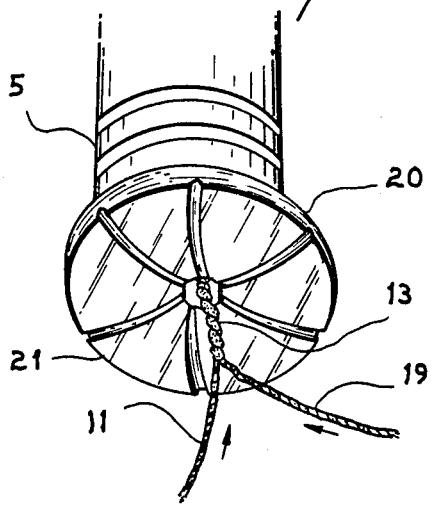
FIG. 2 is a perspective view of a navel used in the spinning machine of FIG. 1 for ply-twisting a rotor spun staple yarn ,with a continuous yarn.

The twisting of the staple yarn 19 is assisted by false twist generated by friction as the yarn contacts navel 20 which is attached to the entrance of stationary doffing tube 5. Staple yarn 19 is plied with the continuous filament yarn 11 at navel 20 as shown in FIG. 2. A ply-twisted combination yarn 13 is formed which advances over break detector 23 and through the nip between take-away rolls 2 and $2^1$. The speed of take-away rolls 2 and $2^1$ in relation to feed rolls 1 and $1^1$ determines the tension placed on the continuous filament yarn 11, which in turn determines the extent to which the plying is balanced. Preferably, the filament yarn 11 being supplied to the spinning machine is wound around feed roll $1^1$ to prevent the yarn from slipping. The combined yarn 13 is wound on package 22 which is driven by a package driving roll 22A.

Referring now to FIG. 3, break detector 23 can be any of the numerous devices available in the industry which is capable of detecting when the first or second component yarn of a plied yarn is missing following a break in either or both of the components.

According to the automatic piecing method of this invention, when a break is detected in either yarn component by break detector 23, feed rolls 1 and $1^1$, take-away rolls 2 and $2^1$, sliver delivery rolls 16, and package 22 and package driving roll 22A are simultaneously disengaged, i.e., by opening the nip or activating an electromagnetic brake-clutch unit or by other capable means. Clamp 24 is activated to clamp and hold yarn 11 in the yarn path while it is cut by cutter 25. Alternatively, yarn 11 may be cut with scissors. If yarn 11 breaks at a location upstream from clamp 24, the yarn has to be advanced over the feed rolls and beyond the clamp and cutter before the clamping and cutting step begins.

Figure 4:
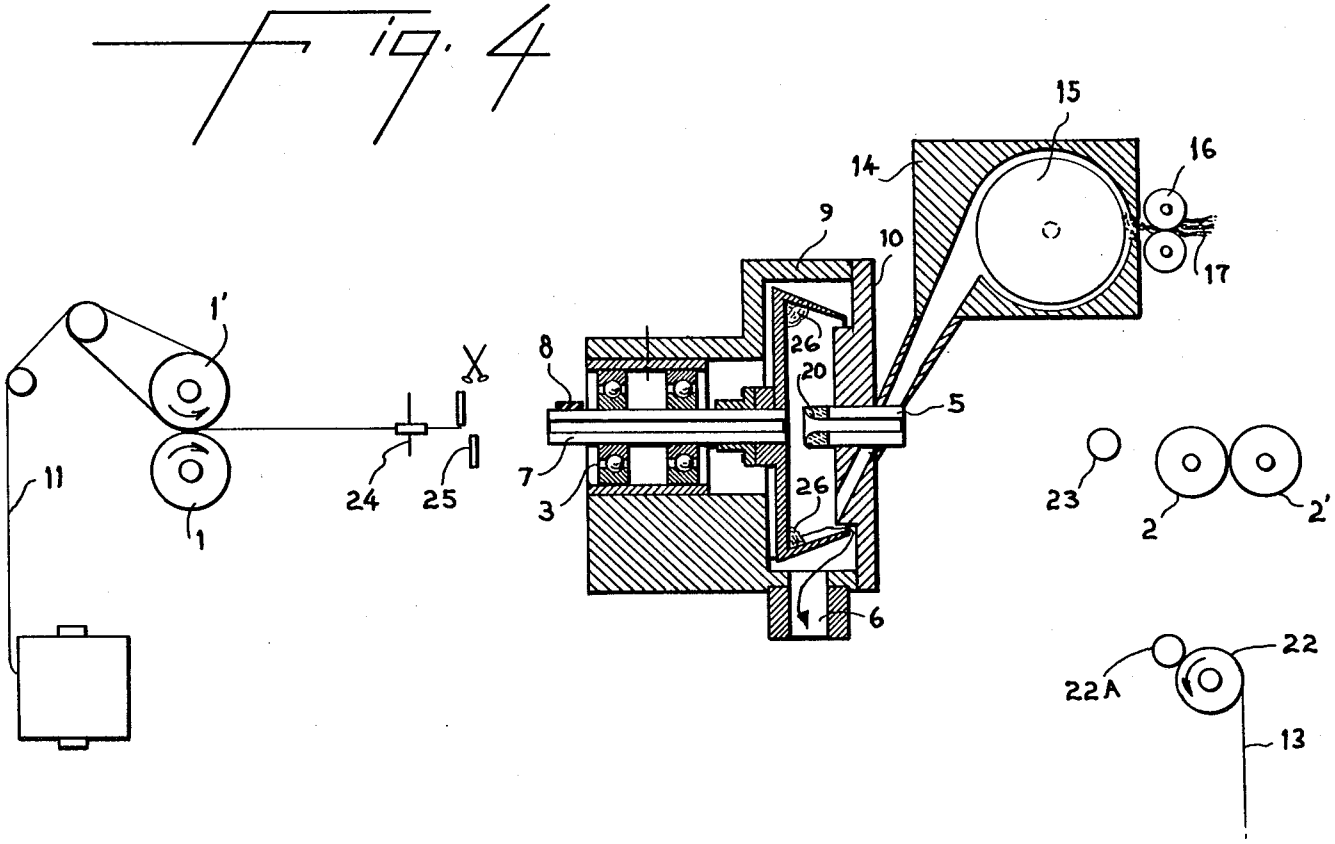

Referring now to FIG. 4, take-away rolls 2 and $2^1$ are disengaged by moving roll $2^1$ away from roll 2 in the direction shown. Roll 2 may rotate permanently without regard to the detection of yarn breakage. Yarn 13 is moved from its normal path and allowed to hang from package 22 as shown. The rotation of rotor 4 is stopped with an appropriate breaking device, and cover plate 10 is opened to exhaust excess staple 26 from the rotor through exhaust passageway 6. If desired, compressed air can aid the removal of the staple fibers and accumulated dust. Thereafter, the rotor may be returned to working speed by releasing the brake at any convenient time before yarn piecing is begun.

Figure 5:
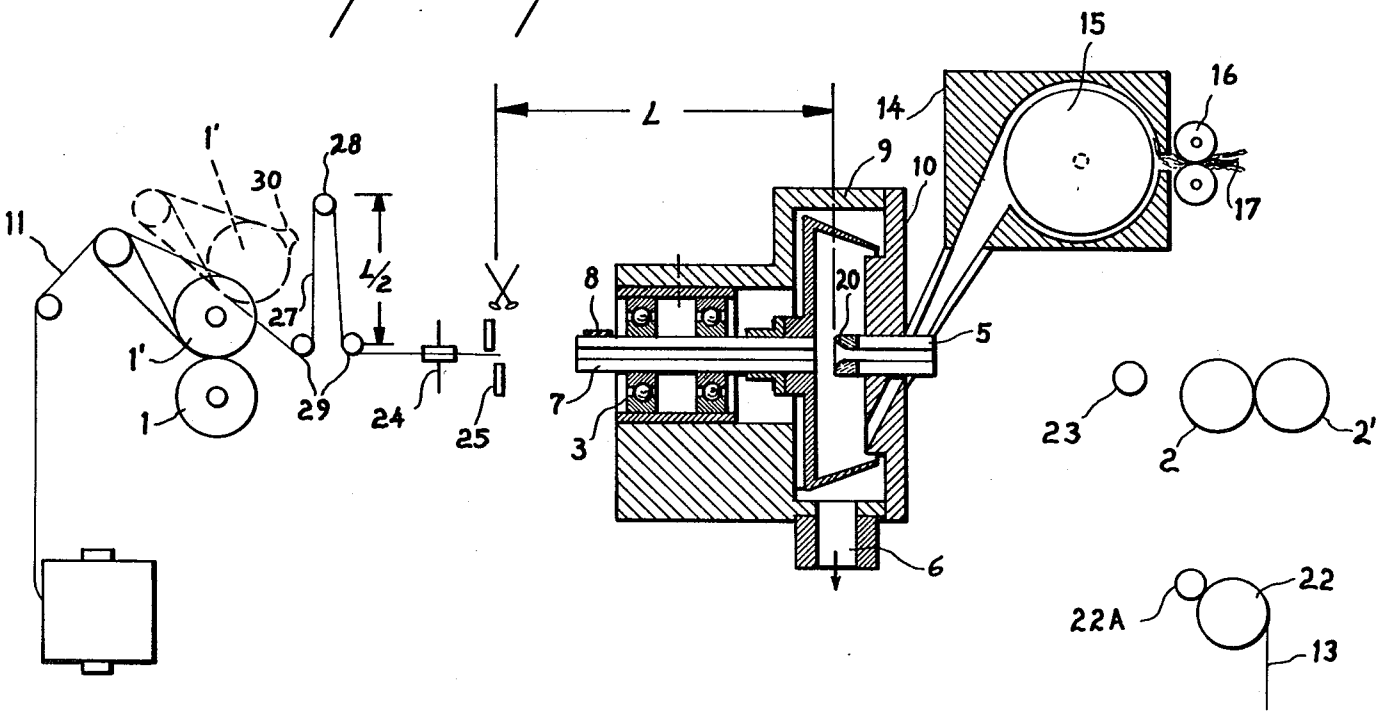

Referring now to FIG. 5, in carrying out the piecing method of this invention, feed roll $1^1$ is moved to an open position out of contact with feed roll 1, which can remain stationary. Roll $1^1$ is restrained by brake 30 to prevent undesired self-motion of roll $1^1$ respectively uncontrolled feeding of the continuous yarn 11, which is wound around feed roll $1^1$. A movable thread guide 28 cooperates with stationary thread guides 29 and moves to a working position to form a loop 27 in yarn 11 as shown. Yarn 11 is restrained by the stationary thread guides 29 and held by clamp 24. The distance which thread guide 28 moves in relation to the stationary thread guides 29 in forming loop 27 is about one-half the distance between cutter 25 and the entrance to doffing tube 5 as indicated by dimension L.

Figure 6A:
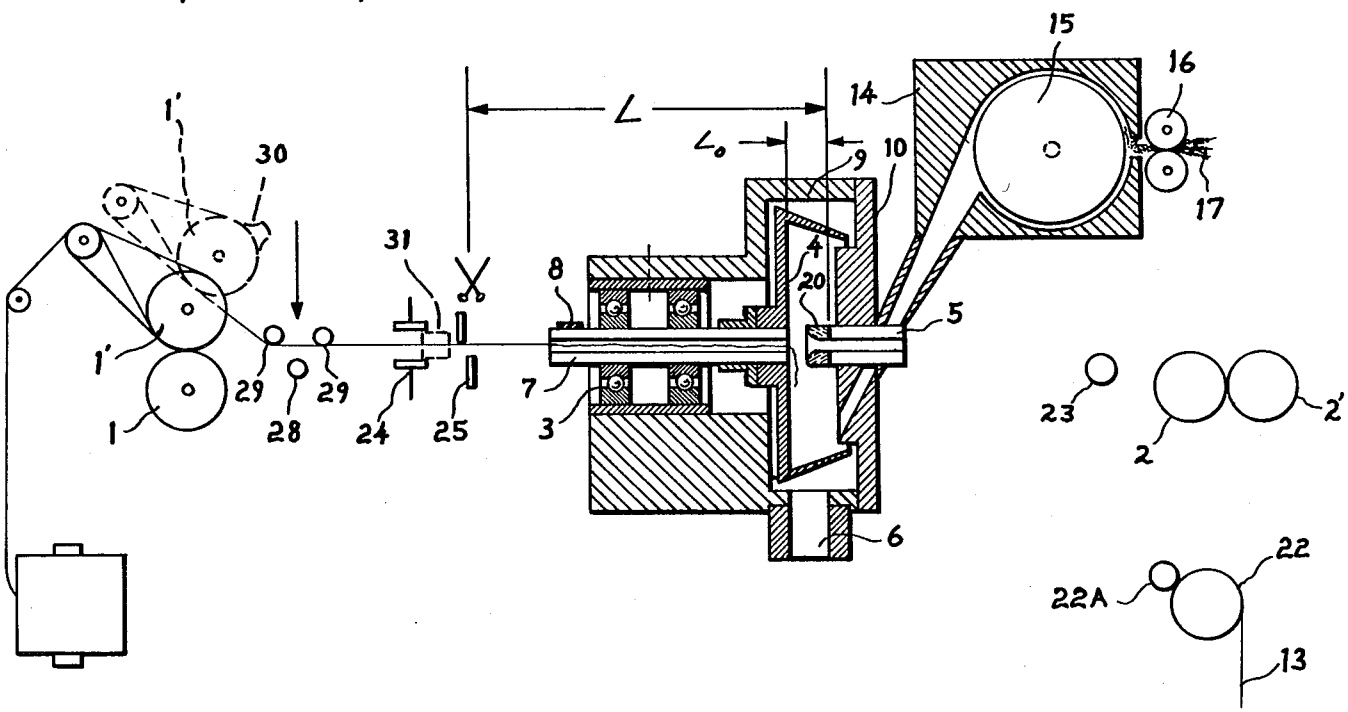

Following the cutting step, clamp 24 releases yarn 11 while thread guide 28 simultaneously moves to an idle position, as shown in FIG. 6A, and loop 27 disappears as yarn 11 feeds through spindle 7 and into rotor 4. Yarn feeding at this point is normally assisted by ambient air flowing through spindle 7 in response to a partial vacuum being created by exhaust 6. The flowing ambient air tends to pull the yarn through the spindle. If desired, an air jet 31 can be placed between clamp 24 and cutter 25, as shown, to push yarn 11 into the spindle. The yarn feeds into the spindle until it extends just beyond the spindle bottom, about a distance which is at least equal to or longer than the distance between the entrance to the doffing tube and the spindle bottom but less than one-half of the radius of the rotor as indicated by the dimension Lo in FIG. 6A.

Figure 6B:
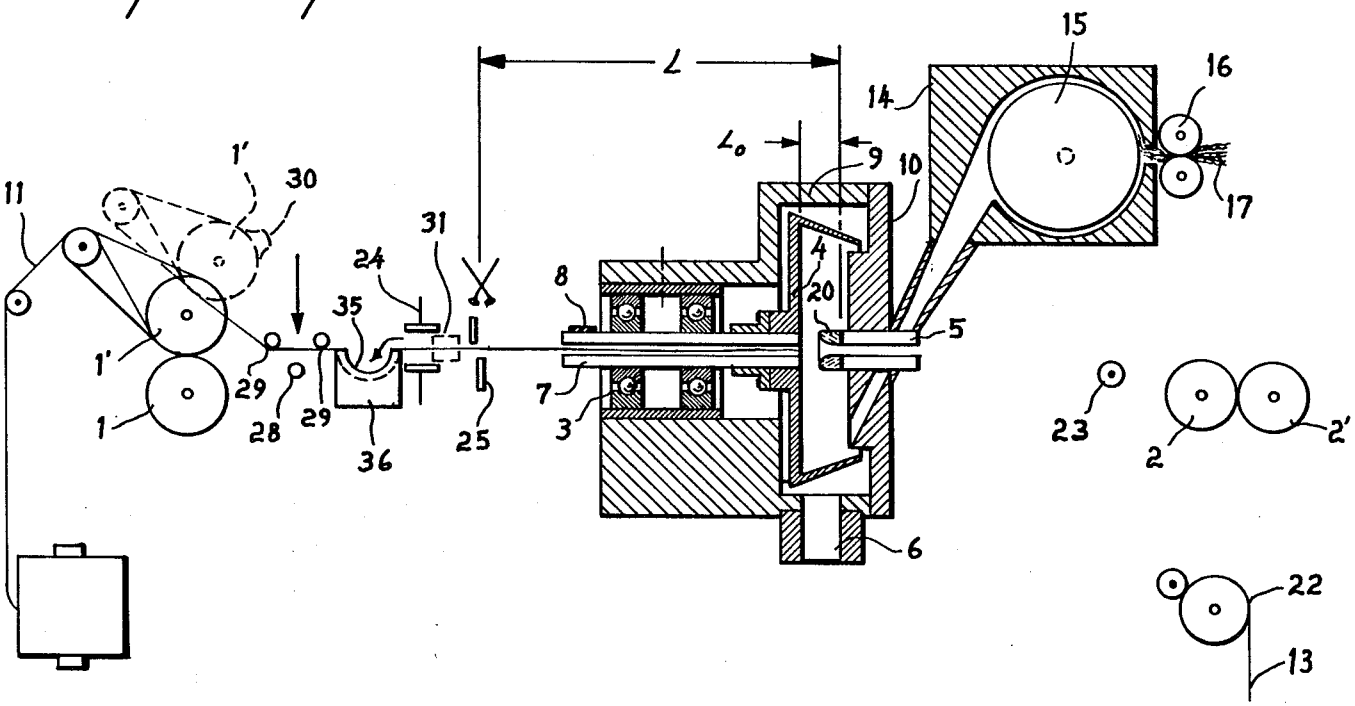

Yarn 11 is then moved upstream, i.e., adjusted, so that its end is approximately flush with the bottom of the hollow rotor spindle as can be seen in FIG. 6B. This is the starting position from which the piecing operation can begin. The movement of yarn 11 to the starting position can be accomplished by any convenient means, such as, for example, by a trough-shaped screen suction device 36, which can operate to form a loop 35 in yarn 11 of a predetermined length, which corresponds with the length Lo of yarn 11 which was extending beyond the spindle bottom. This is the preferred method, although mechanical guide means may also be used. By using a mechanical guide means, the mechanism for forming loop 27 and 35 can be integrated into a single unit.

Figures 7A, 7B, 8:
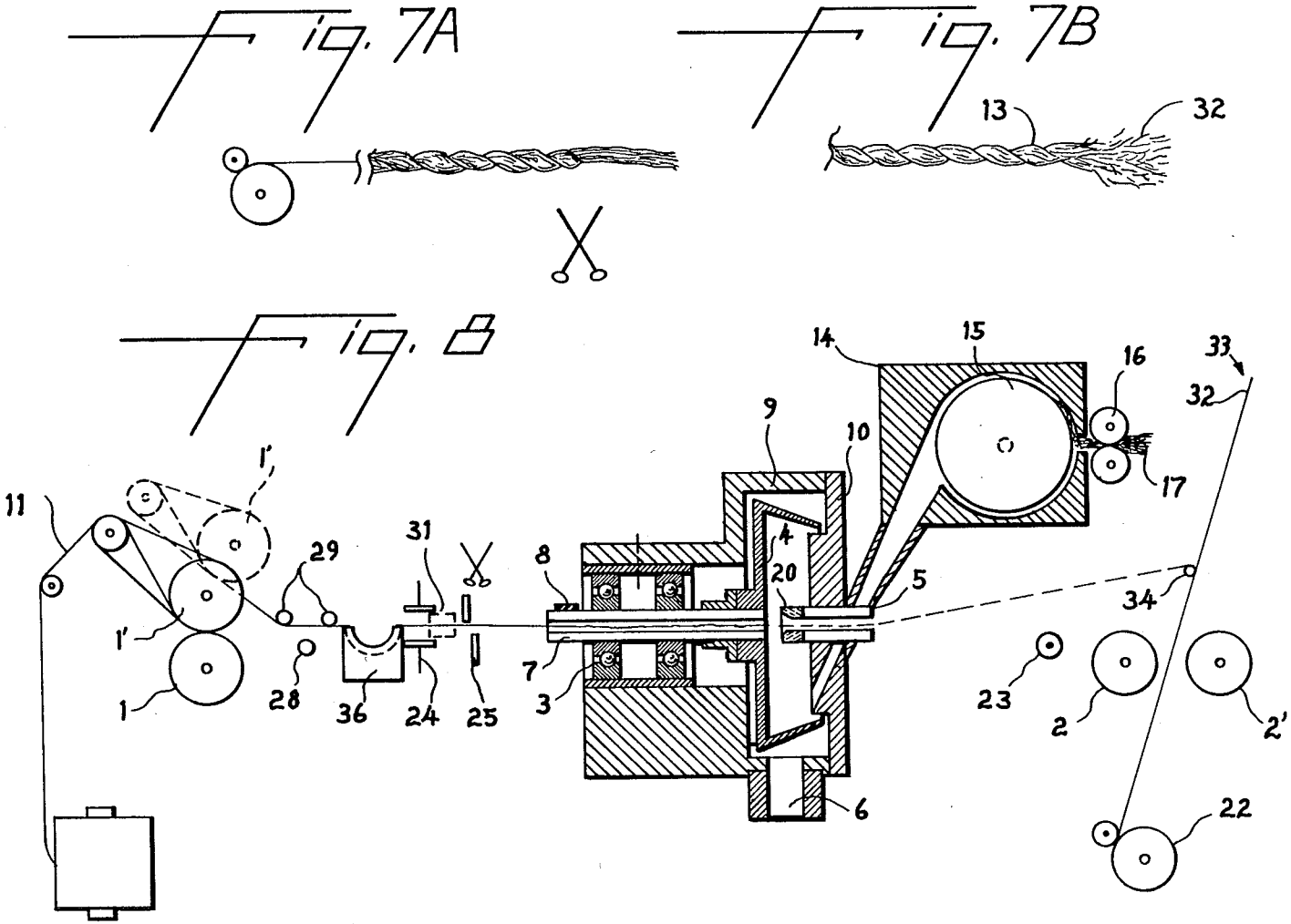
FIGS. 7A–7B are schematic side elevations of the end of a combination yarn in preparation for piecing.
FIGS. 8–9 are schematic side elevations, partly in section, of an open-end spinning machine showing relative yarn positions in practicing the method of the invention.

FIGS. 7A and 7B illustrate how the end of combined yarn 13 from package 22 is prepared for piecing-up. If the combined yarn to be spun is to be collected on a new package 22, i.e., the original package having been filled, a length of ply-twisted combined yarn sufficient to reach from the spinning equipment to the package is first attached to the new package. The yarn end to be pieced-up is examined, and the yarn is cut at a point where both components are present as shown in FIG. 7A. In order to achieve piecing-up with a thickness of the resulting joint being close to the thickness of the unbroken combined yarn, the staple component is removed from the combined yarn so that the continuous component extends beyond the staple component by less than the fiber length of the employed staple fibers. It is also preferred to abrade the end 32 of the continuous yarn, as shown in FIG. 7B, which will allow the staple fibers in the rotor groove to grip the yarn end 32 tightly during piecing-up and avoid forming an unacceptably weak joint.

Referring now to FIG. 8, the combined yarn, having its end 32 prepared for piecing, is passed between take-away rolls 2 and $2^1$ and extended to a predetermined point 33 which provides the desired length for piecing, package 22 being rotated to unwind the yarn. The combined yarn then passes over loop release pin 34, and end 32 is inserted into doffing tube 5. Loop release pin 34 is located so that the available length of combination yarn will allow end 32 to contact the consolidating groove 18 when released by the release pin 34, i.e., the increase in yarn length caused by use of the loop release pin 34 is at least about one-half of the radius of the rotor but not longer than one diameter (2× radius) of the rotor. Yarn end 32 is retained in the desired location within the doffing tube 5 until released by release pin 34 by an inward flow of ambient air created by the partial vacuum from exhaust 6.

The preparatory steps may be performed manually or any degree of automation may be employed as desired. Having completed the preparatory steps, the subsequent steps in the piecing method of this invention preferably are automated and accomplished in a predetermined timed sequence.

Figure 10:
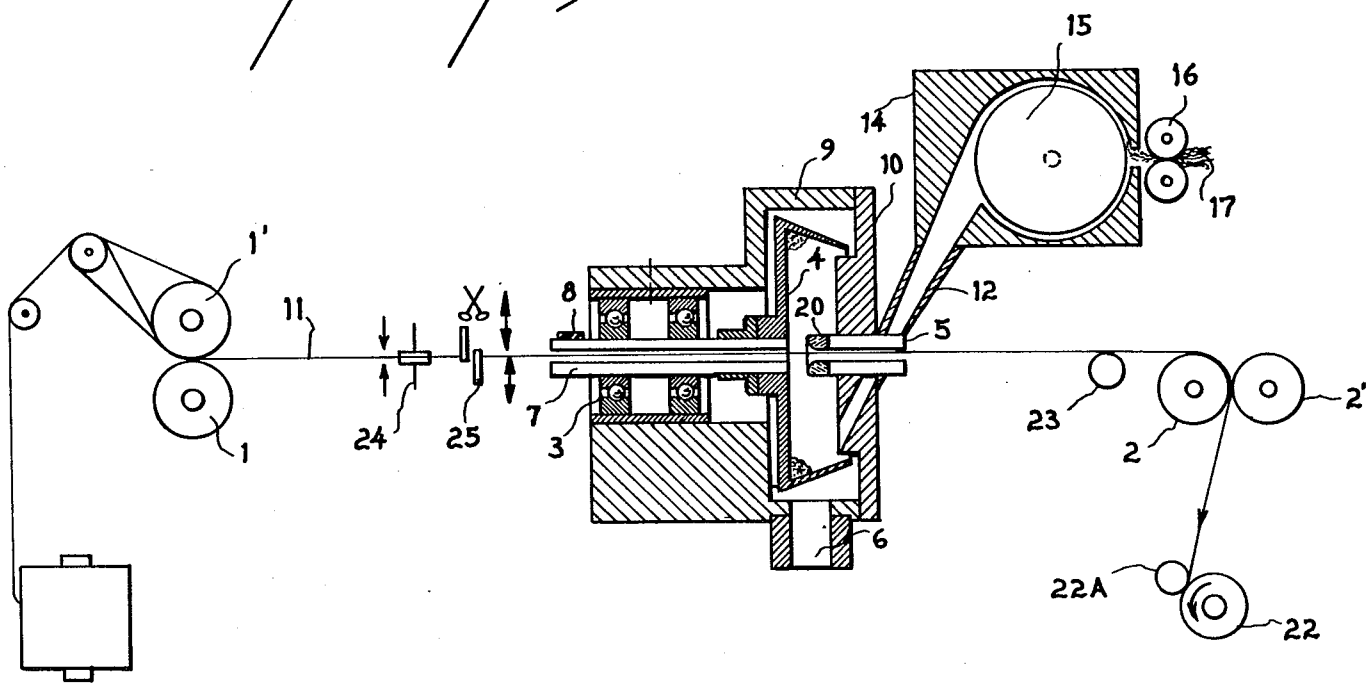
FIG. 10 is a diagram showing the operating phases of the various devices of the open-end spinning machine to which the method of the present invention is applied.
Figure 9:
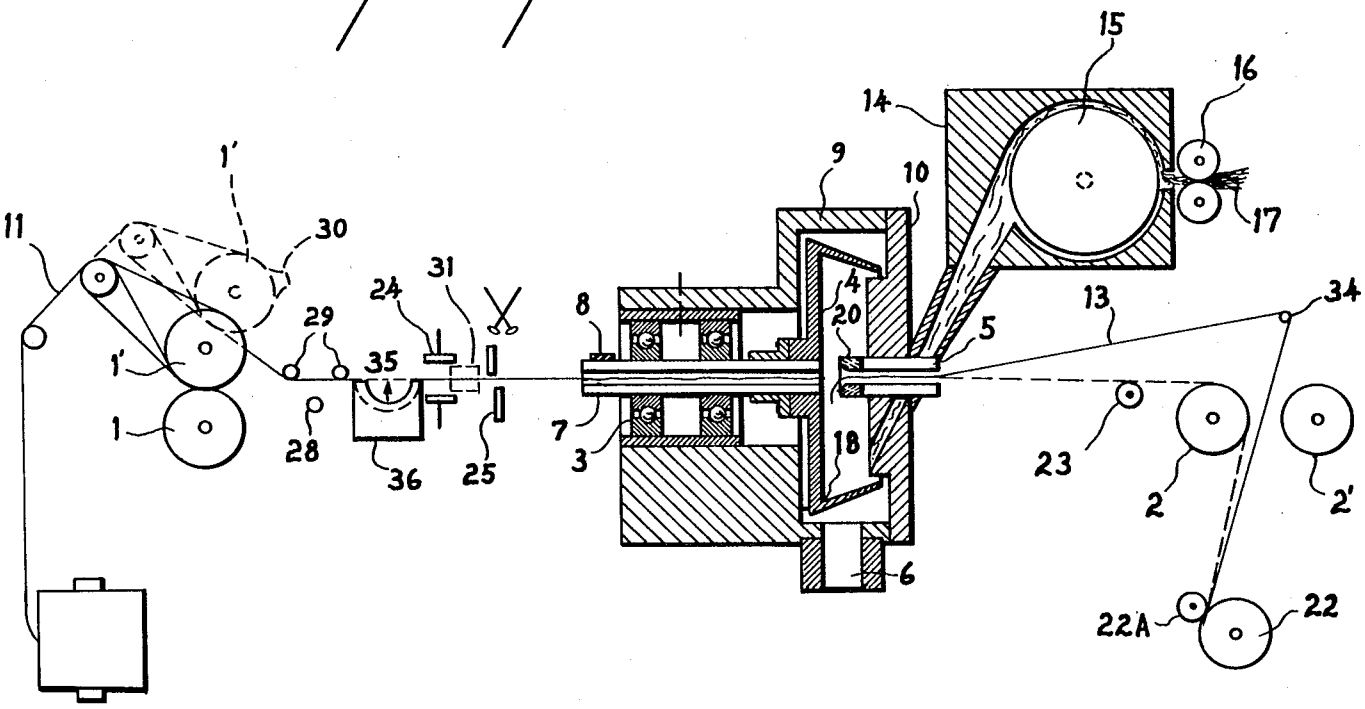
Figure 10:
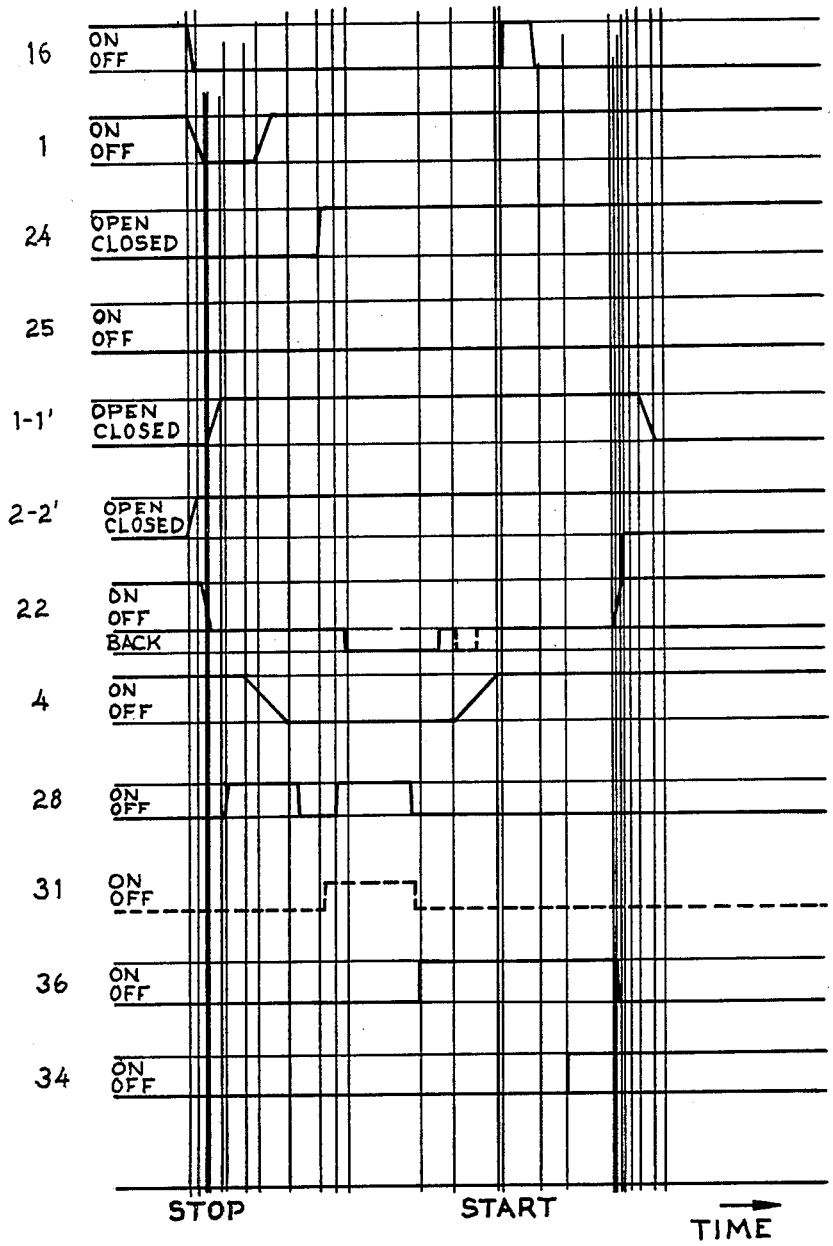
Figure 10:
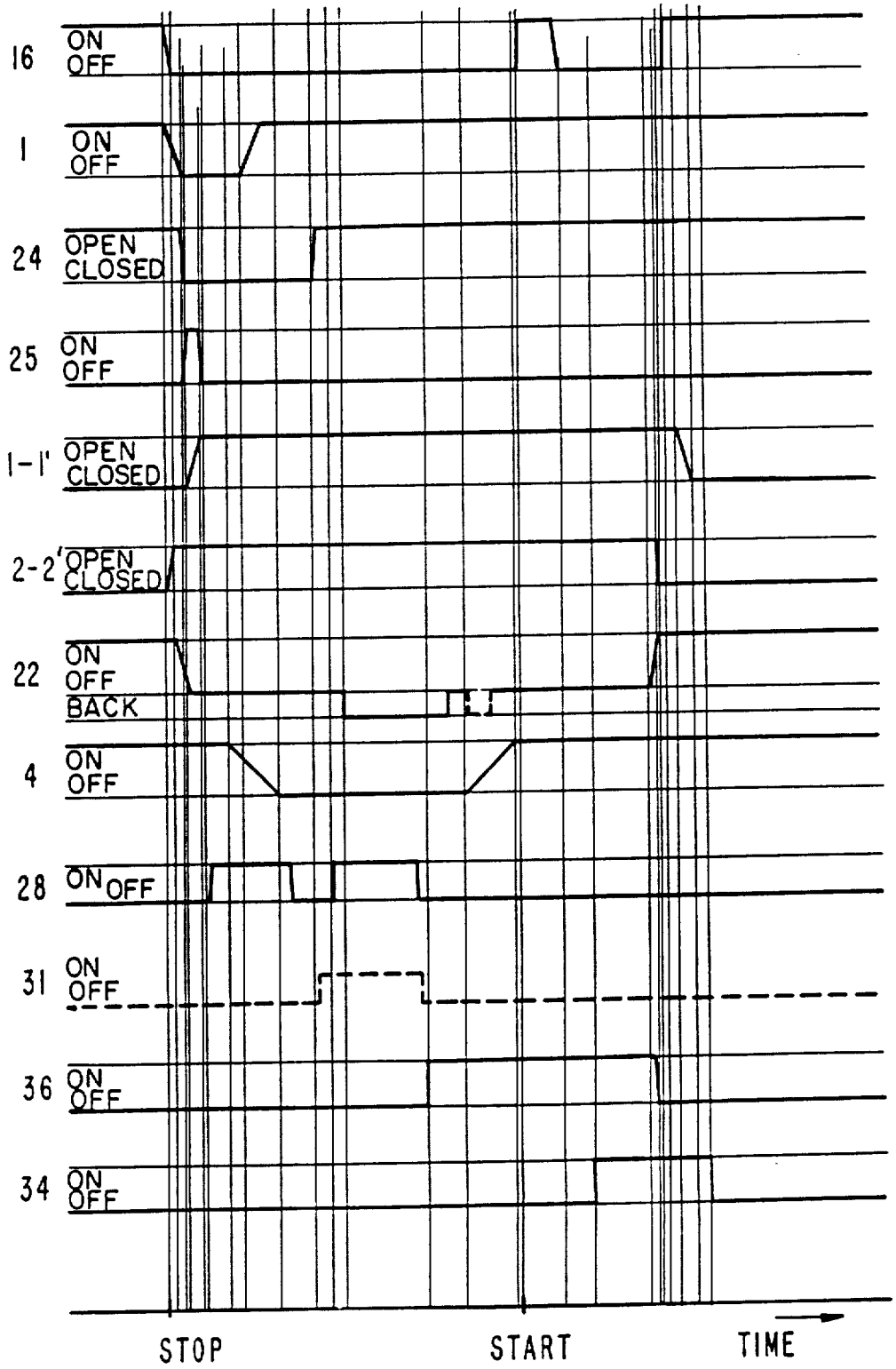

Referring now to FIG. 9, piecing begins by first feeding a predetermined amount of staple fibers into the consolidating groove 18 of rotor 4 which is now spinning at full operating speed. Preferably, the desired amount of staple fibers to begin piecing can be fed by rotating sliver delivery rolls 16 for a predetermined and controlled time interval. An approximate value of this time interval for prefeeding staple fibers can be calculated from the ratio: Rotor circumference ($2\pi R$) divided by the take-away speed. But this calculated time does not include the response time which is necessary to engage and disengage sliver delivery rolls 16. The optimum time for certain spinning conditions has to be determined by tests. Immediately after staple fibers have been fed to the consolidating groove 18, release pin 34 releases yarn 13 which takes the path shown by the dashed line. Yarn end 32 contacts the consolidating groove and is allowed to remain at that location to transfer twist into the twistless staple fibers in the consolidating groove of the rotor for a predetermined and controlled time after which package driving roll 22A begins winding the package. Take-away roll $2^1$ returns to its operating position in contact with roll 2, and loop 35 in yarn 11 is released by removing the suction being pulled by the trough-shaped screen device 36. The continuous filament yarn 11 contacts yarn 13 within the navel 5 without any contact with the consolidating groove 18 of the spinning rotor 4, and feed roll $1^1$ accelerates. The inertia of feed roll $1^1$ creates tension in yarn 11 which prevents a hook or loop from forming at the yarn piecing joint. Without a minimum amount of tension, yarn 11 could form a hook or loop at the piecing joint which would protrude from the finished yarn. Sliver delivery rolls 16 begin continuously delivering staple fibers to the rotor groove. The interruption of staple fiber delivery increases contact time between the twistless staple fibers in the rotor groove 18 and the exposed continuous portion of the combined yarn 13, so that yarn end 32 is allowed to transfer enough twist into the twistless staple fibers in the rotor groove 18 without developing an undesirable fiber mass at the piecing joint. Simultaneously with the continuation of staple fiber delivery, feed roll $1^1$ returns to its operating position in contact with feed roll 1. Roll 1 had been actuated to its feeding speed at any convenient time between opening the nip between roll 1 and $1^1$ and before returning roll $1^1$ to its operating position, which insures balanced ply-twist in the combination yarn 13. As the combined yarn 13 is wound onto package 22, the newly pieced joint passes break detector 23. If no irregularity is detected in the yarn, the piecing method has been successful and the spinning process continues. Referring now to FIG. 10, the operating phases of the various devices of an open-end spinning machine to which the method of this invention can be applied can be seen. The sequence for stopping and starting the operative steps is shown on the vertical axis, and timing is shown on the horizontal axis. In actual practice, timing will ordinarily depend on the rotor spun yarn count and the real twist level (tpi), the dimension and the response time of the starting apparatus.

The method of this invention results in strong piecing joints, i.e., piecing-up points, in which the thickness of the joint is about the same as the balanced ply-twisted finished yarn, i.e., the combined or combination yarn, and no component can be seen protruding from the bundle.

We claim:

1. A method of piecing together a continuous filament yarn and a rotor spun staple yarn with the broken end of a two-ply combination yarn formed by ply-twisting a continuous filament yarn with a yarn of staple fiber on an open-end spinning machine which includes a spinning rotor having a hollow spindle and a consolidating groove, a stationary doffing tube having a navel, a pair of cooperating continuous filament yarn feed rolls, a sliver delivery roll, an opening roller, a pair of cooperating take-up rolls, and a winding-up mechanism comprising the steps of:

disengaging said rotor, feed rolls, delivery roll, take-up rolls and winding mechanism;

removing staple fiber from the rotor;

clamping and cutting said continuous filament yarn and preparing the end of said continuous filament yarn by placing said cut end approximately flush with the bottom of the rotor spindle for restarting;

cutting the combination yarn through both components and preparing the end of said yarn by removing a portion of the staple component to expose the continuous filament yarn component;

returning the rotor to operating speed;

engaging the sliver delivery roll to feed a predetermined amount of staple fiber into the rotor;

moving the prepared end of the combination yarn into the rotor consolidating groove;

moving the end of said continuous filament yarn under controlled conditions into contact with the rotating combination yarn end within the navel without any contact of said continuous filament yarn with the rotor consolidating groove;

engaging the take-up rolls, the feed rolls and the winding mechanism in a predetermined timed sequence to begin take-up and wind-up of the combination yarn.

2. An apparatus to aid in the piecing together of a continuous filament yarn and a rotor spun staple yarn with the broken end of a two-ply combination yarn formed by ply-twisting a continuous filament yarn with a yarn of staple fiber on an open-end spinning machine of the type which includes a spinning rotor having a hollow spindle and a consolidating groove, a stationary doffing tube having a navel, cooperating continuous filament yarn feed rolls, a sliver delivery roll, an opening roller, cooperating take-up rolls, and a winding-up mechanism said apparatus comprising:

means for detecting a break in said two-ply combination yarn in the yarn path downstream of said rotor and disengaging said rotor, feed rolls, delivery roll, take-up rolls and winding-up mechanism in response to said break, a clamp and a cutter located in the yarn path upstream from said rotor and arranged to clamp and then cut said continuous filament yarn in a timed sequence following detection of a break, means for advancing said continuous filament yarn after it has been cut to a position where said cut end is extended within said rotor spindle approximately flush with the bottom thereof, means for preparing the broken end of said combination yarn whereby a predetermined length of continuous filament yarn is exposed, means for advancing said combination yarn end in a direction opposite said continuous filament yarn along the yarn path to a position where said prepared end is in contact with the rotor consolidating groove, means for advancing said continuous filament yarn end under controlled conditions in contact with the rotating combination yarn end within the navel without any contact of said continuous filament yarn with the consolidating rotor groove, means for engaging said rotor, feed rolls, sliver delivery roll, take-up rolls and winding-up mechanism in a predetermined timed sequence to piece together said continuous filament yarn and rotor spun staple yarn with said yarn end of said combination yarn and resume open-end spinning of said two-ply combination yarn.

3. The apparatus of claim 2 in which the means for advancing said continuous filament yarn comprises:

a pair of spaced parallel stationary thread guides located above and perpendicular to said yarn path upstream of said clamp, a movable thread guide located in spaced parallel relation to said stationary guides below the yarn path and arranged to move in a predetermined timed sequence from an idle position below said yarn path to a working position above said yarn path to form a loop of predetermined length in said continuous filament yarn, means for moving said thread guide said idle position and said working position in cooperation with aid clamp whereby said loop disappears and said continuous filament yarn advances along said yarn path.

4. The apparatus of claim 2 in which the means for advancing said combination yarn comprises:

a loop release pin located above said yarn path and arranged to release said combination yarn passing thereover in response to a signal in a predetermined time sequence in cooperation with said engaging means.

5. The apparatus of claim 2 in which said means for advancing said continuous filament yarn to a position where its cut end is approximately flush with the bottom of the rotor spindle comprises:

a suction screen located below said yarn path and having a predetermined sectional configuration in transverse relation to said yarn path, means for releasing said suction in a predetermined time sequence in cooperation with said engaging means.

6. The apparatus of claim 2 in which said means for advancing said continuous filament yarn end under controlled conditions in contact with said rotating combination yarn end within said navel creates a minimum amount of tension in said continuous filament yarn end as it is accelerated by getting contact with said rotating combination yarn end within the navel, to prevent a hook or loop at the piecing joint which would protrude from the finished yarn.

* * * * *

UNITED STATES PATENT OFFICE

CERTIFICATE OF CORRECTION

PATENT NO. : 4,788,817

DATED : December 6, 1988

INVENTOR(S) : Peter Artzt, Gerhard Egbers, Heinz Muller and Ullrich Stark

It is certified that error appears in the above-identified patent and that said Letters Patent are hereby corrected as shown below:

Column 8, line 21, the word "aid" should read -- said --.

Signed and Sealed this

Twenty-eighth Day of March, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,788,817

DATED : December 6, 1988

INVENTOR(S) : Peter Artzt, Gerhard Egbers, Heinz Muller and Ulrich Stark

It is certified that error appears in the above-identified patent and that said Letters Patent is hereby corrected as shown below:

In the drawings, Figure 10 should be deleted to appear as per attached sheet.

Signed and Sealed this

Twenty-seventh Day of June, 1989

*Attest:*

*Attesting Officer*

DONALD J. QUIGG

*Commissioner of Patents and Trademarks*